United States Patent [19]

Nava

[11] Patent Number: 4,820,072

[45] Date of Patent: Apr. 11, 1989

[54] NOTE-BOOK

[75] Inventor: Rinaldo Nava, Milan, Italy

[73] Assignee: Nava Milano S.p.A., Milan, Italy

[21] Appl. No.: 144,344

[22] Filed: Jan. 15, 1988

[30] Foreign Application Priority Data

Jan. 23, 1987 [IT] Italy ..... 20606/87[U]

[51] Int. Cl.[4] ..... B42F 3/00; B42F 13/12; B42F 13/36; B42F 9/00

[52] U.S. Cl. ..... 402/64; 402/68; 402/69; 312/185

[58] Field of Search ..... 402/54, 64, 66, 68, 402/69, 80 R, 500; 411/300, 341, 342, 343, 344, 345, 346, 508, 509, 510, 549; 781/15 A; 312/184, 185, 186, 187

[56] References Cited

U.S. PATENT DOCUMENTS

| | | | |
|---|---|---|---|
| 1,095,944 | 5/1914 | Tallman | 402/64 |
| 3,267,938 | 8/1966 | Kopelovitz | 402/59 |
| 4,000,951 | 1/1977 | Agnew | 402/68 |

FOREIGN PATENT DOCUMENTS

| | | | |
|---|---|---|---|
| 859213 | 9/1981 | U.S.S.R. | 312/185 |

*Primary Examiner*—Frank T. Yost
*Assistant Examiner*—Paul M. Heyrano
*Attorney, Agent, or Firm*—Guido Modiano; Albert Josif

[57] ABSTRACT

Note-book having a cover, constituted by a front flap and by a rear flap joined by a spine, and a stack of sheets joined to one another. The book further includes tabs, protruding from the back of the stack of sheets and removably retainable between the inner surface of the flaps, and trays removably associated with the inner surface of the flaps.

10 Claims, 2 Drawing Sheets

NOTE-BOOK

BACKGROUND OF THE INVENTION

The present invention relates to a note-book.

As is known, note books, for example diaries, agendas or the like are constituted by a stack of sheets, mutually bound to one another, and by a cover, which can have various shapes, but which is in any case made as an integral part connected to the stack of sheets, so that it is not reusable.

Other types of note-books have a cover made of cheap material which is insertable in a jacket which has pockets for the insertion of the flaps of the note-book.

This type of note-book does not solve the problem, since it is in any case necessary to provide a cover for the note-book and furthermore a good connection between the note-book and the added cover is not always achieved.

The above described disadvantage is all the more felt in the case of note-books having, inside the flaps of the cover, regions particularly equipped for the insertion, for example, of calculators, directories, stationery and the like, since their transfer to a new note-book can be in some cases, problematic.

SUMMARY OF THE INVENTION

The aim of the invention is indeed to eliminate the above described disadvantages by providing a note-book with means for the removable connection of the sheets to the cover which allows to easily remove the block of sheets constituting the actual note-book, with the possibility of replacing it, for example, at the end of each year, with a new block of sheets.

Within the scope of the above described aim, a particular object of the invention is to provide a note-book wherein the connection of the sheets to the cover is extremely stable and therefore such as to obtain a practical product and of great quality.

Another object of the present invention is to provide a note-book which, by virtue of its peculiar constructive characteristics, is capable of giving the greatest assurances of reliability and safety in use.

Not least object of the present invention is to provide a note-book with means for the removable connection of the sheets to the cover, which is easily obtainable starting from elements and materials commonly available on the market, and which, furthermore, is advantageous from a merely economical point of view.

The above described aim, as well as the objects mentioned and others which will become apparent hereinafter, are achieved by a note-book comprising a cover, constituted by a front flap and by a rear flap joined by a spine, and by a stack of sheets joined to one another, characterized in that it comprises tabs which protrude from the back of said stack of sheets and are removably retainable between the inner surface of said flaps and trays removably associated with the inner surface of said flaps.

BRIEF DESCRIPTION OF THE DRAWINGS

Further characteristics and advantages of the invention will become apparent from the detailed description of a note-book, illustrated only by way of non-limitative example in the accompanying drawings, wherein.

DESCRIPTION OF THE PREFERRED EMBODIMENTS

Figure 1:
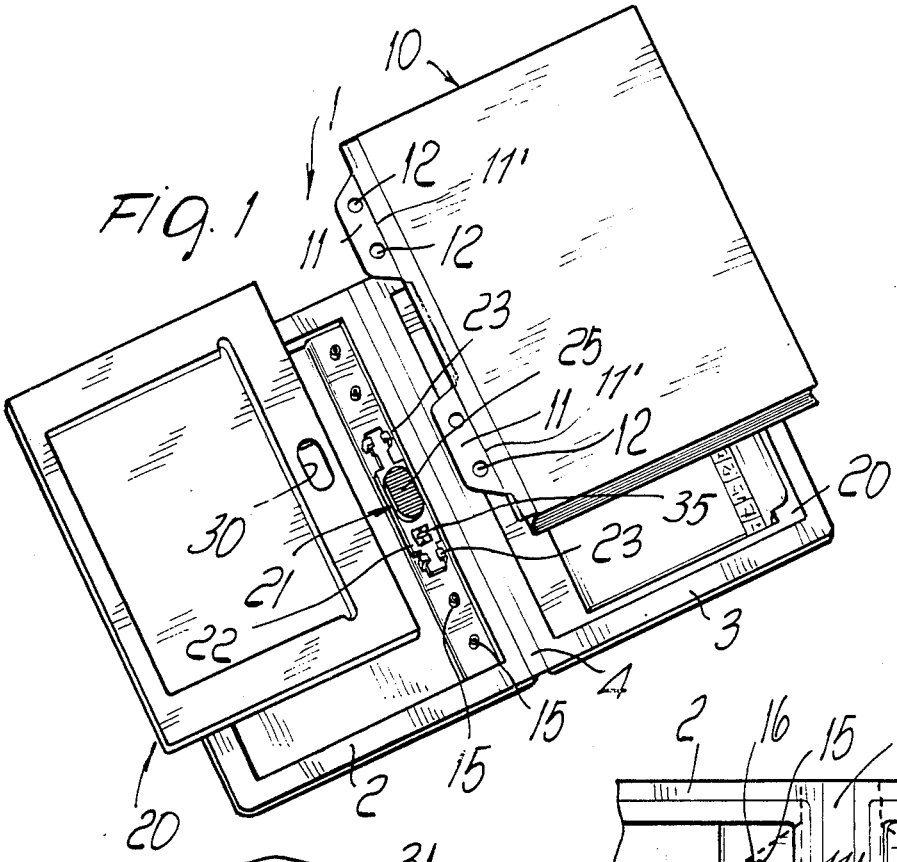
FIG. 1 is a a schematic perspective exploded view of the note-book with the stack of sheets shown separately.
Figure 3:
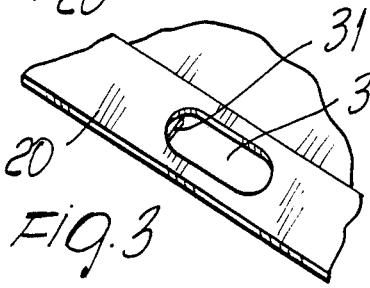
FIG. 3 is a view of the detail of the hole provided on the trays.
Figure 4:
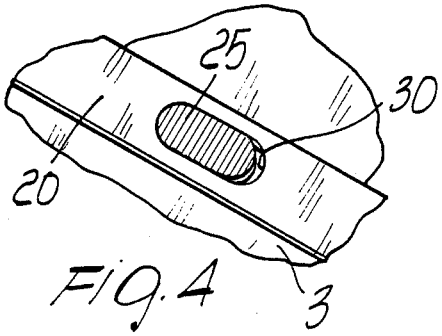
FIG. 4 is a detail view of the key of the slider for locking the trays inside the flaps.
Figure 2:
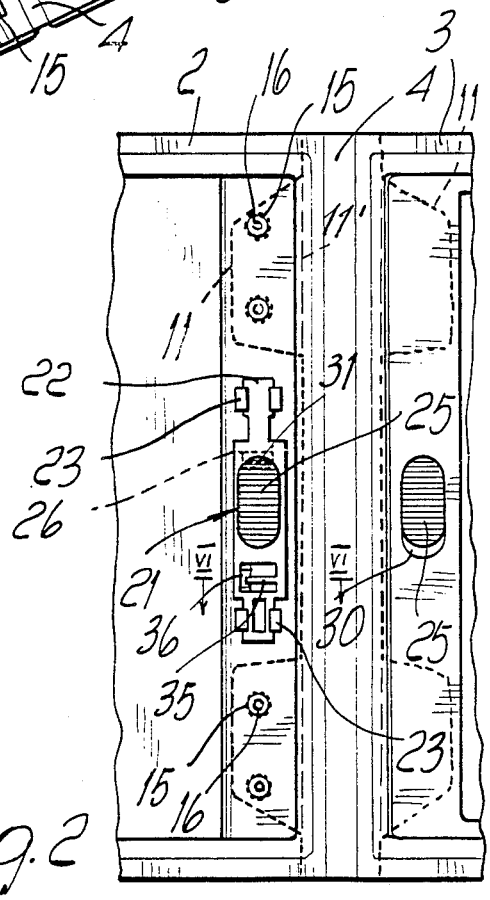
FIG. 2 is a plan view of the detail of the connecting means.

With reference to the above described figures, the note-book, generally indicated by the reference numeral 1, comprises a cover which is constituted by a front supporting flap 2 and by a rear supporting flap 3 which are joined by a flexible spine 4; preferably the spine as well as the edges of the flaps are made of flexible plastic, while the flaps are constituted by rigid elements which are practically included in the molding of the plastic material.

A stack of sheets, which constitutes the basic part of the book, generally indicated by the reference numeral 10, is insertable inside said cover in association with each of the supporting flaps 2, 3.

Means are provided for the removable connection of the stack of sheets 10 to the cover, which are constituted by connecting tabs 11 which protrude laterally from the back of the stack of sheets and are providrd with through holes 12.

Centering pins 15 with an inner cavity 16 are provided correspondingly inside the flaps 2 and 3, and insert in said holes. The connecting tabs can be folded with respect to the stock of sheets 10 along the folding line 11; thus enabling insertion of the pins 15 into the through holes 12.

The tabs are in practice locked between the inner surface of the flaps 2 and 3 and of the trays 20, however equipped, which are removably connected to the inner surfaces of the flaps.

In order to retain the trays 20 in position, locking means are provided which are preferably constituted by a slider 21 which has a plate-like region 22 slideably guided between guiding tabs 23 defined by the inner surface of each of the supporting flaps.

The slider 21 has a button-like portion 25 which is provided, at one end, with an undercut recess 26. The button protrudes from an oval hole 30 defined on the edge of the trays and provided, at one longitudinal end, with a locking tooth 31 which by inserting in the recess 26 in practice locks the tray with respect to the flap.

Moreover, an elastic stem 35 is provided in a cavity of the plate-like body of the slider and its free and is elastically accommodatable in a positioning recess 36 formed on the inner surface of the underlaying flap to keep the slider in a-rest position in which the locking tooth engages the recess 26.

Figure 5:
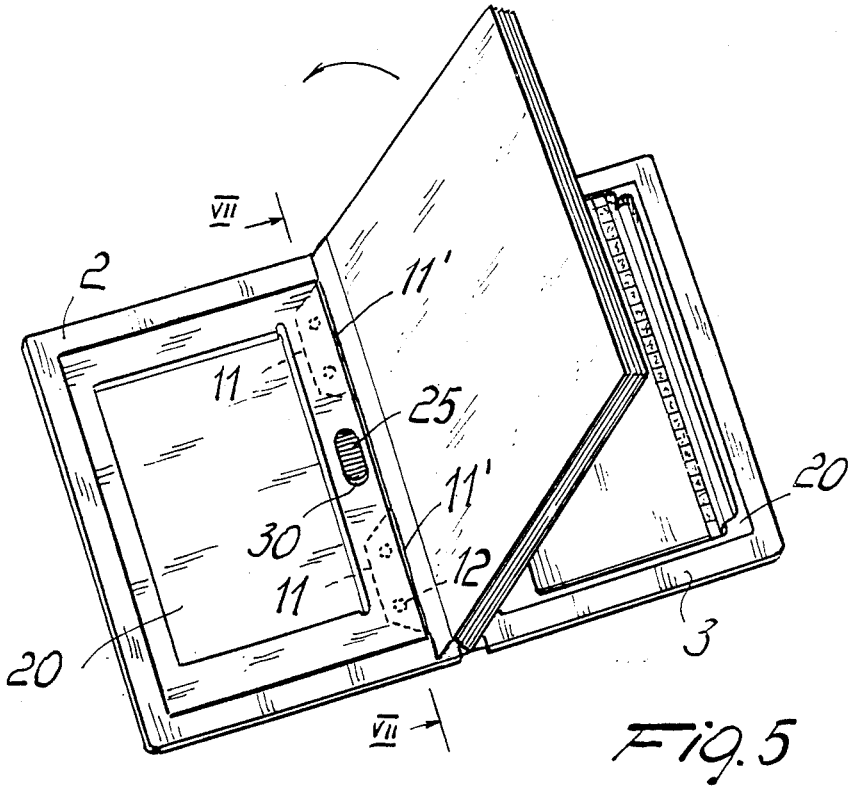
FIG. 5 is a general perspectic view of the note-book with the stack of sheet being associated with the cover in an upright position and with the flaps open.
Figure 7:
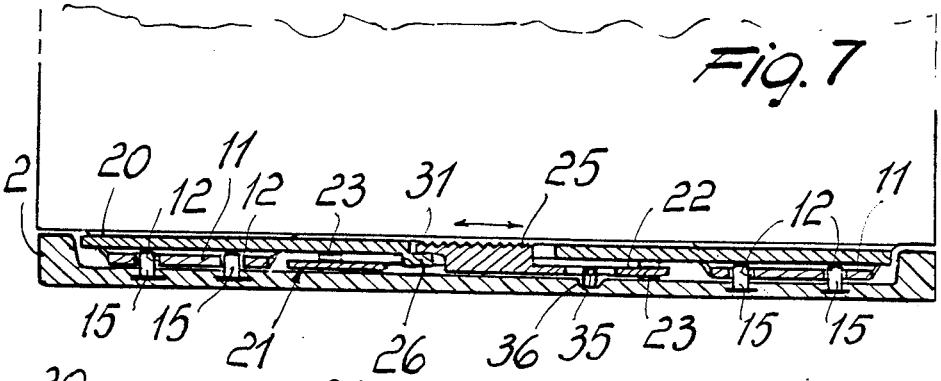
FIG. 7 is a lateral sectional view of the connecting means along the lines VII—VII of FIG. 5.
Figure 6:
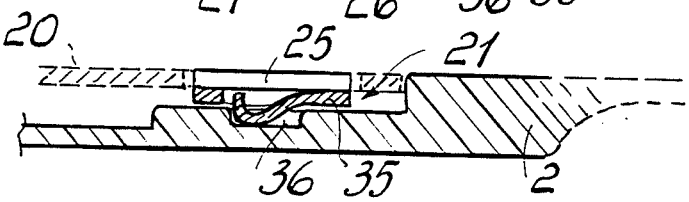
FIG. 6 is a lateral detailed sectional view of the slider along the lines VI—VI of FIG. 2.

In practical use, once the tabs are positioned by inserting the pins 15 in the corresonding holes 12 of the connecting tabs 11 with the stack of sheets in a substantially upright portion as shown in FIG. 5, the related tray is applied to the inside of the flaps so that the button 25 protrudes from the oval hole 30, then a reduced translatory motion is performed so that the recess 26 of the button 25 couples to the locking tooth provided at the end of the oval hole. At this point, the stack of sheets can be rotated along the folding line 11' in order to be superposed to the related tray, thus permitting closure of the flaps over each other.

In order to remove the book and replace it with a new one, naturally the above described operations are performed in reverse order.

In this manner the stack of sheets which constitutes the books is firmly held to the cover, thus constituting an integral part thereof, having however the possibility of easily removing the stack of sheets for its rapid replacement.

From what has been described it can thus be seen that the invention achieves the intended aims and in particular the fact is stressed that it is possible to rapidly and simply interchange the stack of sheets, obtaining however a book in which said stack of sheets is stably connected to the outer cover.

In practice, the materials employed, as well as the contingent dimensions and shapes, may be any according to the requirements.

I claim:

1. A note-book comprising a cover in association with at least one replaceable stack of sheets, said cover having one front and one rear supporting flap formed of substantially rigid material and having a substantially rectangular shape, a spine formation of substantially flexible material for mutually joining said front and rear supporting flaps along adjacent edges thereof and allowing said flaps to substantially close over each other, means being provided on said flaps proximately to said adjacent edges thereof for removably connecting said stack of sheets to said cover, the sheets of said stack being separably joined to each other along a lateral edge thereof to form the back of said stack, wherein said stack of sheets comprises a pair of connecting tabs projecting away from said back at longitudinally spaced locations thereof, and wherein said means for removably connecting said stack of sheets to said cover comprise at least one separate and substantially planar tray element arranged to face the inner surface of one of said supporting flaps with the interposition of said pair of connecting tabs, and further comprise operable locking means mounted on said inner surface of one of said flaps for cooperating with said at least one tray element, whereby actuation of said operable locking means causes said tray element to be firmly held in place against said inner flap surface so releasably locking said pair of connecting tabs to thereby removably associate said stack of sheets to said cover.

2. A note-book according to claim 1, wherein each connecting tab has a plurality of through holes, at least one of said front and rear supporting flaps having two spaced apart sets of upright extending pins which are rigidly anchored to the inner surface of said at least one of said flaps for coordinated engagement with said through holes of said pair of connecting tabs to allow positioning of said stack of sheets on said cover.

3. A note-book according to claim 2, wherein said positioning pins have an internal axial cavity.

4. A note-book according to claim 1, wherein said operable locking means comprise guide means attached to the inner surface of at least one of said supporting flaps and extending in a substantially parallel direction to said inner surface thereof, and further comprise a slider movably retained in said guide means, said slider having a substantially elongate planar base portion and an elevated button-like portion centrally formed on said substantially planar base portion.

5. A note-book according to claim 4, wherein said button-like portion has an elongate shaped base of shorter length than said planar base portion, said guide means comprising at least two pairs of opposite guiding tabs projecting from said inner flap surface and arranged to lateraly and upwardly retain the planar base portion of said slider during longitudinal movement thereof.

6. A note-book according to claim 4, wherein said at least one tray element has a substantially oval through hole formed proximately to one edge thereof and arranged to allow free passage of said button-like portion therethrough, said button-like portion having an upper grip surface protruding from said oval hole to permit an user's finger to act thereon to cause longitudinal movement of said slider.

7. A note-book according to claim 6, wherein said elevated button-like portion has an undercut recess formed at one end thereof and extending in a substantially parallel direction to said guide means.

8. A note-book according to claim 7, wherein said substantially oval hole has an inwardly extending tooth projecting from the the internal surface thereof, said projecting tooth being formed at the end of said oval-hole which is facing said undercut recess and being complementary shaped to said undercut recess, actuation of said button-like portion causing movement of said slider from a rest position in which said tooth engages said undercut recess, thereby firmly associating said stack of sheets with said cover, to an operative position in which said tooth is disengaged from said undercut recess thereby permitting separation of said stack of sheets from said cover.

9. A note-book according to claim 8, wherein elastic positioning means are provided for normally elastically maintaining said slider in said rest position, said elastic positioning means comprising an internal cavity formed on said elongate base portion of said slider, an elastic stem having one end attached peripherally to said internal cavity and extending substantially transversely to said elongate base portion, the other end of said elastic stem being freely movable within said internal cavity, a positioning recess being formed on the upper surface of the supporting flap, said positioning recess being so arranged to elastically accomodate the free end of said elastic stem in such a manner that said undercut recess is urged against said tooth.

10. A note-book according to any preceding claim, wherein said pair of connecting tabs define longitudinal folding lines with respect to said stack of sheets, whereby initial positioning of said connecting tabs on one of said supporting flaps and locking thereof by means of one tray element can be accomplished with said connecting tabs extending substantially coplanar away from said stack of sheets or partially folded with respect therto, said stack of sheets being further completely folded over said connecting tabs with the interposition of said tray element in such a manner to overlay the supporting flap after association of said stack of sheets to said cover to thereby permit positive closure of the supporting flaps on each other.

* * * * *